United States Patent [19]

Mackenroth, III et al.

[11] 4,130,902

[45] Dec. 26, 1978

[54] COOLING HATBAND

[76] Inventors: Joseph R. Mackenroth, III, 8117 McArthur Dr., Harahan, La. 70123; Hugo B. Bode, 9555 King Crest Pkwy., Baton Rouge, La. 70810

[21] Appl. No.: 820,755

[22] Filed: Aug. 1, 1977

Related U.S. Application Data

[63] Continuation-in-part of Ser. No. 701,858, Jul. 1, 1976, abandoned.

[51] Int. Cl.[2] ..... A42B 1/18

[52] U.S. Cl. ..... 2/7; 2/171.2; 2/182.3; 2/182.7; 150/2.3

[58] Field of Search ..... 2/7, 182.2, 182.3, 182.5, 2/182.7, 181.2, 181.8, 181, 182.1, 171, 171.2; 150/2.2, 2.1, 2.3, 2.4

[56] References Cited

U.S. PATENT DOCUMENTS

| | | | |
|---|---|---|---|
| 103,703 | 5/1870 | Beatty | 2/182.5 |
| 594,209 | 11/1897 | Mears | 2/7 |
| 1,405,061 | 1/1922 | Mouromtzeff et al. | 2/7 |
| 2,010,132 | 8/1935 | Bischoff | 2/7 X |
| 2,218,590 | 10/1940 | Szumkowski | 2/181.8 |
| 2,832,077 | 4/1958 | McGinnis | 2/181.2 X |
| 3,029,438 | 4/1962 | Henschel | 2/7 |

*Primary Examiner*—Peter Nerbun
*Attorney, Agent, or Firm*—Keaty & Garvey

[57] ABSTRACT

An improved cooling hatband is comprised of a structural support band which is affixable to the desired headpiece. An absorbent flexible liquid retaining band is attachable to the support band with a net fastener. The absorbent band is provided with a matrix of indented slots through which air can pass to optimize evaporation. The structural band is provided with a corresponding intermeshing matrix of openings which register with the intermeshing openings of the absorbent band when the absorbent band is connected to the structural band by means of the net fastener, allowing air to freely circulate through the assembled hatband.

16 Claims, 6 Drawing Figures

COOLING HATBAND

REFERENCE TO RELATED APPLICATIONS

This is a continuation-in-part of the co-pending patent application, Ser. No. 701,858, filed July 1, 1976 now abandoned and entitled "Cooled Safety Construction Helmet".

BACKGROUND OF THE INVENTION

1. Field of the Invention

The present invention relates to hats and hat bands, and more particularly relates to a cooling hatband for use with an attached headwear wherein the cooling effect is achieved by the evaporative action of water which is dispensed continuously to the cooling hatband.

2. General Background and Prior Art

Many situations dictate that an individual be required to wear a hat or like headwear. For example, in the construction industry, O.S.H.A. regulations stipulate that all personnel on construction projects wear a "hardhat" or like helmet. This regulation makes sense, as injuries and deaths can be prevented by the hardhat protecting the wearer's head from falling objects and the like. In hot weather, as often occurs during the summer months, hardhats, helmets and like headwear can be quite uncomfortable when the temperature increases to 80° and more.

GENERAL DISCUSSION OF THE PRESENT INVENTION

The present invention provides a cooling hatband which has a structural support band attachable to a helmet, "hardhat", or any desirable headwear. The support band actually abuts the the head of the wearer and supports the hat properly thereon. The support band has an adjacent, corresponding absorbent band which is capable of retaining liquid therein such as water or the like. The absorbent band is provided with a matrix of interlacing slots which register, upon mounting, with the structural band to a matrix of like interlacing openings in the structural band. Thus, air could pass through the support band and intermingle and contact with the liquid contained within the absorbent band. The absorbent band is adhered to the support band by means of a net fastener. The net fastener is a matrix of elongated thread-like members which form an interlacing arrangement, the individual thread like members being registerable with the matrix of slots of the absorbent band and the matrix of openings on the support band.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Band Construction

Figure 1:
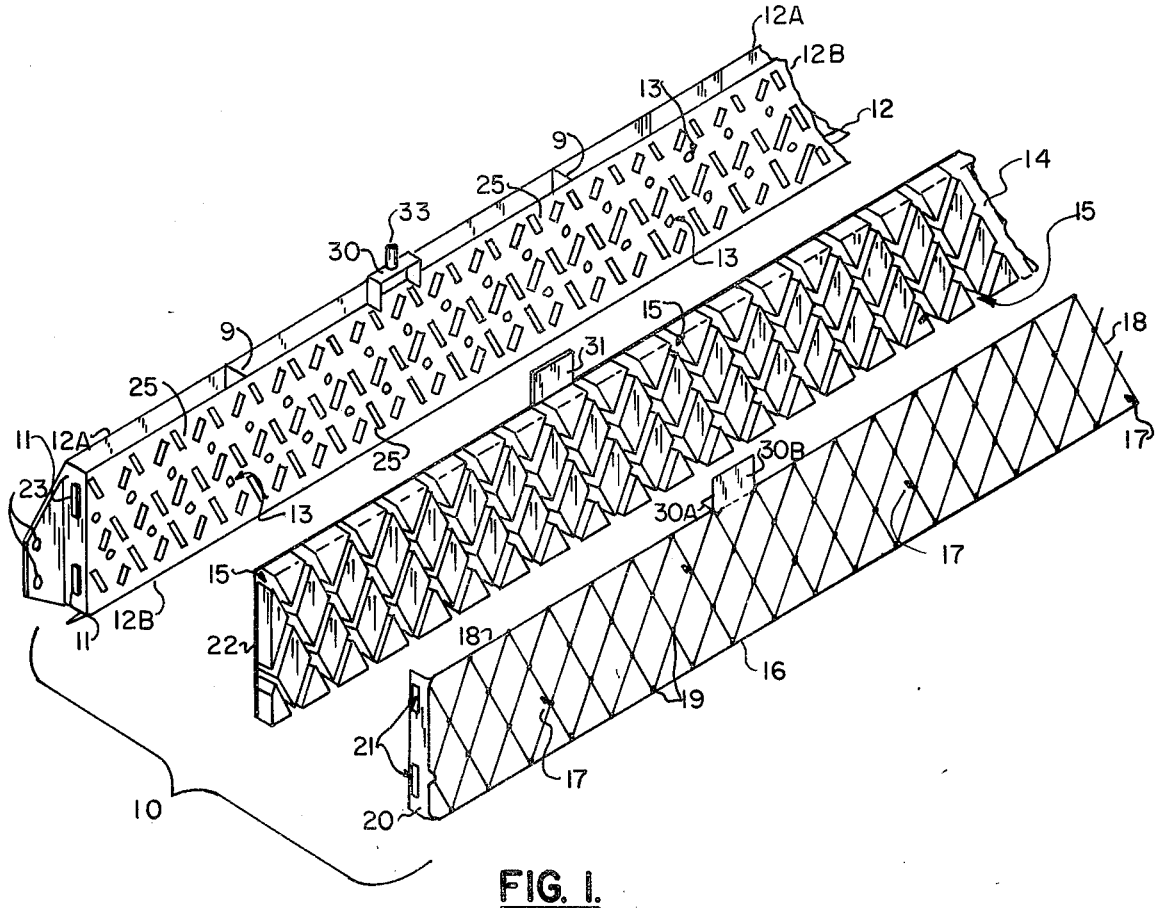
FIG. 1 is a perspective, exploded, partial view of the preferred embodiment of the apparatus of the present invention.

FIG. 1 illustrates the preferred embodiment of the apparatus of the present invention, designated generally by the numeral 10. The hatband 10 is comprised generally of a support band 12 which can be manufactured of any suitable supportive but pliable material such as plastic, an injection moldable plastic being an exemplary material. An absorbent band 14 which is capable of retaining liquid therein is fastened to support band 12 in a face-to-face arrangement by means of net-like fastener 16. FIG. 1 shows the three main components of cooling band 10 in a partial perspective, exploded view, but it can be seen that the three components will be easily assembled by abutting absorbent band 14 to structural band 12 and fastening it in position with fastener 16.

Fastener 16 is provided with a plurality of barbed male connectors 17 which register in corresponding circular openings 13 of support band 12. Fastener 16 is formed by a plurality of interlaced cables 18 which are connected at knots 19 to form an overall net as is best illustrated by FIG. 1. At its end portions, net fastener 16 is provided with a strap 20 having openings 21 therein. Strap 20 registers and connects to the end portion of support band 12 at lugs 11 to further complete a suitable connection of net fastener 16 to support band 12. Net fastener 16 could be of any strong fiber or line or like supportive material such as injection molded plastic monofilament, as is used in the manufacture of fishing line or the like.

Absorbent band 14 is held into face-to-face engagement with support band 12. Note that absorbent band 14 is "sandwiched" between net fastener 16 and support band 12, the face-to-face engagement with support band 12 being perfected when net fastener 16 is secured to support band 12 by means of male connections 17 as was discussed more fully, supra.

Absorbent band 14 can be of any liquid retaining and/or absorbing material such as foam , sponge, cloth, synthetic chamois or the like. Absorbent band 14 features a plurality of slots 15 therein arranged in a matrix form as is illustrated best by FIG. 1. The matrix of slots 15 increase the surface area of absorbent band 14 and thus the area upon which evaporation can occur and thus increase the cooling effect of the apparatus 10 of the present invention. It can be seen that the slots 15 of absorbent band 14 are arranged to correspond and register with the cables 18 of net fastener 16. Thus, when the connection of the three components 12, 14 and 16 is perfected, net fastener 16 will register with and occupy a position within the matrix of slots 16 in absorbent band 15. If desired, the absorbent band can be provided with backing 22 for added strength. Backing 22 and support band 12 are provided with a matrix of air vents 25 through which air can pass and contact absorbent band 14. It should be understood that the vents 25 will form a matrix which will correspond to and coincide with the matrix of slots 15 in absorbent band 14 and the matrix of cables 18 of net fastener. Thus, on assembly, air will freely pass through support band 12, backing 22 and contact the absorbent band 14 to effect evaporation of liquid contained therein and thus produce cooling effect. As long as water is retained within and present for evaporation from the absorbent band 14, the cooling hatband 10 will operate properly to cool the headwear to which it is attached (for example, a construction helmet).

The overall hatband 10 can be attached to the desired headwear by means of riveting or like conventional means at mounting holes 23.

Figure 2:
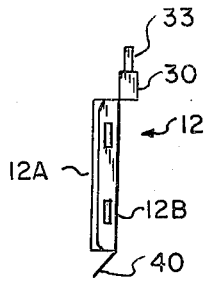
FIG. 2 is an end view of the support band portion of the present invention.

Support band 12 can be constructed of two elongated straps 12*a*, 12*b* connected at suitable intervals by stiffeners 9, thus air can freely flow through support band 12 as is desirable. Scoop 40 can be provided at the lower portion of band 12 to channel air between straps 12*a*, 12*b* (see FIG. 2).

Figure 4:
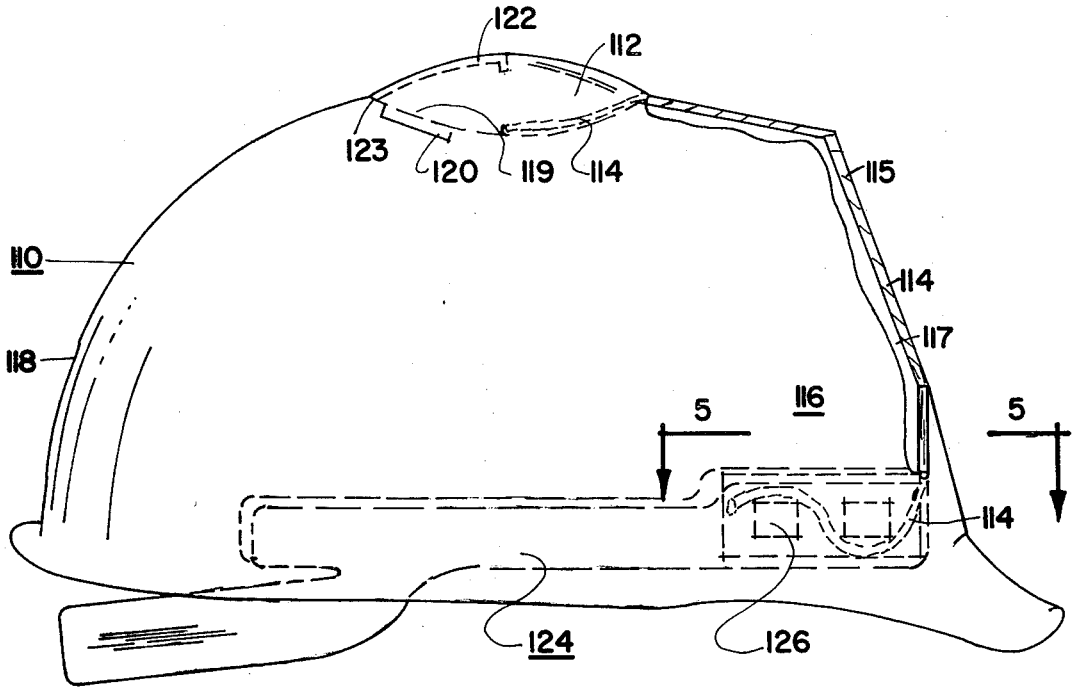
FIG. 4 is a side elevation, partially cut away and showing in broken lines interior items and construction of an alternative embodiment used in a construction hard hat.
Figure 5:
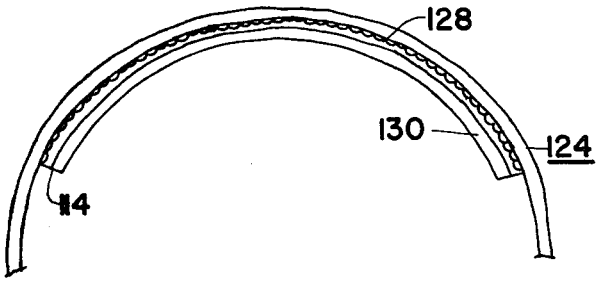
FIG. 5 is a cross-sectional view taken along section line 5—5 of FIG. 4.

FIGS. 4–5 illustrate an alternative embodiment of head band construction used in an exemplary illustration with a construction hard hat.

Referring to FIG. 4, the invention comprises a safety construction helmet 110 in which water reservoir 112 is fixed interiorly in the top of the helmet. A wick 114 connects the bottom of reservoir 112 through a passageway 115 to a partially laminated headband 116 and extends between said laminations around a forehead contacting section of said headband. The interior of the helmet 110 is blackened to attract infra-red heat radiated from the head of a wearer of the helmet, and the exterior is conventionally light colored for radiating heat to the outside air.

Referring to FIG. 4, the water reservoir 112 is preferably moulded into the top of helmet 110 as it is manufactured. A filling opening 119, closable by a cap 120, is defined below the middle and to one side of the reservoir for introducing water or any convenient liquid therein. An interior air-bleed tube 122 extends from the top of the interior of the reservoir to a vent 123 to the exterior thereof adjacent opening 119 for preventing the formation of a vacuum in the reservoir as liquid is removed therefrom by wick 114.

Figure 6:
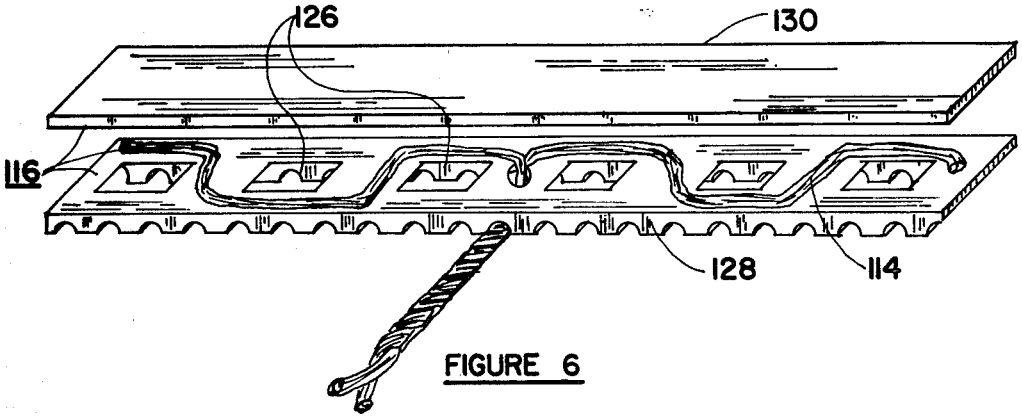
FIG. 6 is an enlarged, exploded and three dimensional view of the matter of FIG. 5.

Referring to FIGS. 5 and 6, the partially laminated headband 116 comprises a conventional helmet headband 124 of impermeable material that extends adjustably around the head of a wearer of helmet 110. Headband 124 has a plurality of holes 26 defined therethrough in a forward part 128. A headband strip 130 comprising absorbent material is fixed to headband 124 extensive with pat 128. Wick 114 is sandwiched therebetween and passes above and below holes 126 alternately in a wave pattern.

In use, water from the reservoir is lead down the wick to dampen the headband strip 130 from which it is evaporated and passes through holes 126. The evaporation removes heat from the headband 130 and the forehead of the helmet wearer to cool them. Heat from the rest of the wearer's head is of an infra-red nature and, attracted to the blackened interior surface of helmet 110, passes to the lighter colored exterior by conduction and radiates from said helmet exterior to the surrounding air.

WATER DISTRIBUTION

The cooling hatband 10 receives a supply of water or like suitable evaporative fluid from a supply vial of liquid contained within the headwear to which hatband 10 is connected. Such a vial (not shown) would convey fluid through a suitable duct or like conduit to liquid transfer container 30.

Although any evaporative fluid would suffice, a volatile chemmical is not necessary. With the improved distribution provided with the present invention, water alone will suffice as the cooling fluid.

Liquid transfer container 30 is formed in part on support band 12. A wick 31 extends upwardly from absorbent band 14 and is contained within container 30 when hatband 10 is assembled. The container 30 is closed and made substantially fluid tight when net fastener 16 is assembled to support band 12 sandwiching absorbent band 14 therebetween and its associated wick 31, as net 16 has container bottom 30*a* and container side 30*b* thereon.

Figure 3:
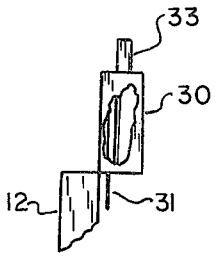
FIG. 3 is a partial cut-away view of the cooling hatband of the present invention illustrating the liquid transfer container and its associated wick.

As can best be seen in FIG. 3, the assembled hatband 10 features the enclosed container 30 with a conduit connection 33 thereon through which water can enter container 30 from a suitable supply vial (not shown). Thus, fluid from a supply vial can continually soak wick 31 and travel therethrough by capillary flow absorbent band 14 maintaining it in a moistened state where evaporation will occur to give the desired cooling effect to the headwear to which the present invention is attached.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A cooling hatband, comprising:

a. a supportive hatband member affixable to a headpiece;

b. liquid absorbing evaporation means in face-to-face contacting arrangement with said hatband member throughout a portion of its length, said evaporation means providing a cooling surface contacting the head of the wearer along said portion of its length; and c. water supply means in cooperative fluid connection with said evaporation means for continually adding water to said evaporation means as water added to said evaporation means is evaporated wherein said liquid absorbing evaporation means is a band of absorbent material i close face-to-face connection with said hatband member, and there is provided a plurality of openings in said absorbent band through which air can pass, and there is a corresponding plurality of openings which register with the opening in said absorbent band and which are located in said supportive hatband member, said openings allowing air to simultaneously, freely pass through both said hatband member and said absorbent band of material effecting an evaporation of water contained within said absorbent band.

2. The cooling hatband of claim 1, wherein said water supply means is comprised of:

a. a vial of liquid;

b. a wick in fluid connection with said liquid absorbing evaporation means; and c. transfer means for transferring liquid within said vial to said wick.

3. A cooling hatband, comprising:

a. a supportive hatband member affixable to a headpiece;

b. liquid absorbing evaporation means in face-to-face contacting arrangement with said hatband member throughout a portion of its length; and c. water supply means in cooperative fluid connection with said evaporation means for continually adding water to said evaporation means, and wherein said absorbing evaporation means is a band of absorbent material in close face-to-face connection with said hatband member, and there is provided a plurality of openings in said absorbent band through which air can pass, and there is a corresponding plurality of openings in said supportive hatband member, said openings allowing air to simultaneously, freely pass through both said hatband member and said absorbent band of material effecting an evaporation of water contained within said absorbent band, and said openings within said absorbent material form a matrix of slots in said absorbent material, and there is provided a cooperative matrix of openings in said hatband which register with said matrix of slots in said absorbent material when said hatband member and said absorbent band are assembled in a face-to-face arrangement.

4. The cooling hatband of claim 1, further comprising, connection means for holding said liquid absorbing evaporation means in face-to-face arrangment with said hatband member, said connection means being removable allowing disassembly of said absorbent evaporation means from said hatband member

5. The cooling hatband of claim 3, further comprising, connection means for holding said liquid absorbing evaporation means in face-to-face arrangement with said hatband member, said connection means being removable allowing disassembly of said absorbent evaporation means from said hatband member.

6. The cooling hatband of claim 5 wherein said connection means is a matrix of connected cables which attach said absorbent band to said hatband member, said cables registering with and falling in said matrix of slots in said absorbent material when the connection between said absorbent band and said hatband is perfected, said matrix of cables being provided with a plurality of connectors which attach to said supportive hatband member.

7. A cooling hatband comprising:

a. a supportive hatband member, said hatband member being provided with a first plurality of regularly-spaced openings therein;

b. a band of absorbent material in close face-to-face connection with said hatband member, and said band of absorbent material is provided with a second plurality of regularly-spaced openings corresponding to and registering with the regularly-spaced openings of said hatband member, said first and second set of openings allowing air to freely pass through both said hatband member and said absrbent band of material;

c. a vial of supply liquid;

d. a wick in fluid connection with said absorbent band;

e. transfer means for transferring liquid within said vial to said wick; and f. connection means for affixing said band of absorbent material to said hatband member in face-to-face arrangement, said connection means being removable allowing disassembly of said absorbent band from said hatband member.

8. The cooling hatband of claim 7 wherein said connection means is a matrix of connected cables which attach said absorbent band to said hatband member, said cables registering with and falling in said matrix of slots in said absorbent material when the connection between said absorbent band and said hatband is perfected, said matrix of cables being provided with a plurality of connectors which attach to said supportive hatband member.

9. The cooling hatband of claim 8, wherein said vial of supply liquid is affixable to a headpiece, and there is provided urging means for enhancing the flow of liquid from said vial to said wick.

10. The cooling hatband of claim 9 wherein said urging means is capillary action.

11. Headwear with built-in cooling means comprising:

a. headwear means for covering the wearer's head, said headwear means being provided with a liquid dispensing reservoir therein;

b. liquid diffusing headband means within said headwear means for holding said headwear means on the wearer's head and for diffusing water received by said headband means from said reservoir to substantially all parts of said headband means, said headband means extending about the length of at least one half of the inner periphery of said hedwear means and being in substantially continuous contact with the head of the wearer;

c. duct means connecting said reservoir and said headband means for conveying liquid contained within said reservoir to said headband means; and d. air contact means on said headband means comprising a plurality of regularly spaced matrix openings extending about the length of at least one half of the inner periphery of said headband means for allowing air to contact the liquid contained within said headband means there being provided a corresponding second cooperative matrix of openings in a supportive hatband means which second cooperative matrix of openings register with said openings in said headband means when said supportive hatband means and said headband means are assembled in a face-to-face arrangement.

12. The headwear of claim 11 wherein said air contact means is a plurality of spaced openings.

13. The headwear of claim 11 wherein said headband means is comprised of:

a. a flexible supporting headband, said headband being provided with a plurality of spaced openings therein; and b. a water retaining member in contact with said headband, said water retaining member allowing water within said member to contact said band near said plurality of openings.

14. The headwear of claim 13 wherein said water containing member is an elongated wick woven through said supporting headband near said openings therein.

15. The apparatus of claim 14 wherein said headwear means is a protective hard helmet.

16. The apparatus of claim 15 wherein said protective helmet is provided with a darkly colored interior surface portion and a light colored exterior surface portion.

* * * * *